US007258591B2

(12) United States Patent
Xu et al.

(10) Patent No.: US 7,258,591 B2
(45) Date of Patent: Aug. 21, 2007

(54) MOBILE ROLY-POLY-TYPE APPARATUS AND METHOD

(75) Inventors: Yang-Sheng Xu, Shatin N.T. (HK); Hang Tong, Yuen Long N.T. (HK); Shu-Shang Zhao, Shatin N.T. (HK); Wing-Seng Fong, Shatin N.T. (HK)

(73) Assignee: The Chinese University of Hong Kong, Shatin N.T. (HK)

( * ) Notice: Subject to any disclaimer, the term of this patent is extended or adjusted under 35 U.S.C. 154(b) by 0 days.

(21) Appl. No.: 10/678,050

(22) Filed: Oct. 1, 2003

(65) Prior Publication Data

US 2004/0198159 A1 Oct. 7, 2004

Related U.S. Application Data

(60) Provisional application No. 60/438,339, filed on Jan. 6, 2003.

(51) Int. Cl.
*A63H 15/04* (2006.01)

(52) U.S. Cl. ..... 446/273; 446/274; 446/325; 446/351; 446/353; 446/379

(58) Field of Classification Search ..... 446/269, 446/396, 274, 273, 275, 279, 280, 458, 233, 446/234, 462, 286–288, 325, 330, 351, 353, 446/324, 326, 457, 431, 379; 473/570, 571, 473/594

See application file for complete search history.

(56) References Cited

U.S. PATENT DOCUMENTS

| | | | | | |
|---|---|---|---|---|---|
| 901,762 | A | * | 10/1908 | Wetzel | 446/297 |
| 933,623 | A | * | 9/1909 | Cecil | 446/273 |
| 1,349,202 | A | * | 8/1920 | Holbrook et al. | 446/273 |
| 1,518,108 | A | * | 12/1924 | Rapp | 446/325 |
| 1,763,903 | A | * | 6/1930 | Perkins | 446/273 |
| 3,500,579 | A | * | 3/1970 | Bryer | 446/462 |
| 3,589,058 | A | * | 6/1971 | Labat | 446/179 |
| 4,391,224 | A | * | 7/1983 | Adler | 119/707 |
| 4,541,814 | A | * | 9/1985 | Martin | 446/456 |
| 4,698,043 | A | * | 10/1987 | May et al. | 446/273 |
| 4,726,800 | A | * | 2/1988 | Kobayashi | 446/458 |

(Continued)

FOREIGN PATENT DOCUMENTS

| | | |
|---|---|---|
| FR | 2215798 | 8/1974 |

(Continued)

OTHER PUBLICATIONS

International Search Report for application No. PCT/CN2004/000010, mailed Apr. 29, 2004.

*Primary Examiner*—Bena Miller
(74) *Attorney, Agent, or Firm*—Knobbe Martens Olson & Bear LLP

(57) ABSTRACT

The present invention generally relates to apparatuses having some characteristic(s) of traditional "roly-poly" toys, which are traditional passive toys that, when struck, wobble about their typically-rounded base but stay upright due to bottom-heavy weighting. Some embodiments of the present invention can be especially relevant to such an apparatus that is mobile and/or not totally passive. For example, some embodiments of the present invention have locomotive ability, for example, via one or more wheels or other type of roller(s)

6 Claims, 7 Drawing Sheets

U.S. PATENT DOCUMENTS 4,921,458 A 5/1990 Greenwood
5,169,354 A 12/1992 Norton et al.
5,871,386 A 2/1999 Bart et al.
6,402,630 B1 * 6/2002 Tyler ..... 473/125
6,569,025 B1 * 5/2003 Tyler ..... 473/125

FOREIGN PATENT DOCUMENTS

GB 2319756 A * 6/1998

* cited by examiner

MOBILE ROLY-POLY-TYPE APPARATUS AND METHOD

CROSS REFERENCE TO RELATED APPLICATIONS

The present patent application claims the benefit of priority from commonly-owned U.S. Provisional Patent Application No. 60/438,339, filed on Jan. 6, 2003, entitled "Maneuverable Mobile Device and Method", which is hereby incorporated by reference in its entirety for all purposes.

TECHNICAL FIELD

The present invention generally relates to apparatuses having some characteristic(s) of traditional "roly-poly" toys, which are traditional passive toys that, when struck, wobble about their typically-rounded base but stay upright due to bottom-heavy weighting. The present invention can be especially relevant to such an apparatus that is mobile and/or not totally passive.

BACKGROUND

A traditional roly-poly toy (RPT), or "tumbler" toy, is a passive toddler's toy that can manage to stay upright despite apparent attempts to topple it. When physically disturbed, the RPT rocks about its typically rounded base, and perhaps is incidentally displaced a very short distance from place to place, but does not topple over. Failure to topple is due to the toy's bottom-heavy weight distribution. When the toy's positioning is disturbed, the toy rocks in an interesting manner and ultimately, absent further disturbance, returns to an upright position. FIG. 1 shows an example 5 of a traditional RPT. A traditional RPT has no locomotive capability.

The traditional RPT differs from various other types of apparatuses, including, for example, locomotive toy vehicles. Typically and traditionally, locomotive toy vehicles take the form of boats, airplanes, walking or crawling devices, or conventional multi-axle vehicles having wheels or "caterpillar" tracks. Locomotive toy vehicles may be remotely controlled (e.g., wirelessly by a human operator) or controlled autonomously via on-board navigation logic.

There have been some efforts made to create locomotive vehicles of relatively a typical design. For example, locomotive vehicles exist that are each supported and driven solely by a single roller—for example, a single ball-shaped wheel. FIGS. 2A-2B schematically show one example of such a conventional single-roller locomotive toy vehicle 10, called the "Sphericle". The Sphericle 10 is a hollow sphere that has a conventional four-wheeled, dual-axle car 12 in its interior. As the wheeled car 12 attempts to drive "up" (as shown by arrow 14) the interior wall of the sphere 10, gravity on the wheeled car 12 causes the sphere to roll (as shown by arrow 16) relative to the ground, thereby causing the spherical 10 to achieve locomotion (as shown by arrow 18). The Sphericle is described further in Bicchi, Antonio, et al., "Introducing the 'Sphericle': an Experimental Testbed for Research and Teaching in Nonholonomy", Proceedings of the 1997 IEEE International Conference on Robotics and Automation, Albuquerque, N. Mex., U.S.A., April, 1997.

Another example of a vehicle having only a single, spherical wheel is discussed in Koshiyama, A. and Yamafuji, K., "Design and Control of an All-Direction Steering Type Mobile Robot", International Journal of Robotics Research, vol. 12, no. 5, pp. 411-419, 1993, hereinafter "Koshiyama et al.". In Koshimaya et al., a single-wheeled locomotive robot includes a compact "arched body" above the wheel that is kept very stable by computer-directed stability control, such that "a cup of water placed on the top of the arched body of the robot could be carried without any spilling" (Koshimaya et al., left column, page 418). The robot of Koshimaya et al. touches the ground at its single wheel and also at two sensor arms that extend from the sides of the spherical wheel, at its axle ends, and trail on the ground.

Another class of vehicles having a typical design is the "parallel bicycle", as recently exemplified by the much-publicized "Segway" vehicle, which is a vehicle that during use balances its body on only two parallel wheels that share a common axis of rotation. The body of the Segway vehicle is inherently unstable when driven, and the body is maintained in relatively upright position due to active computer-directed stability control. Under the stability control, an electronic computer receives positional sensor feedback and, based thereupon, gives rapid and frequent micro-bursts of drive power (including reverse or braking power) to the wheels in order to maintain an otherwise precarious balance. The balance is otherwise precarious such that, soon after the vehicle becomes un-powered, its body would lose balance and topple to touch the ground for direct support, for example, at a kickstand of the body, if the kickstand is extended. The Segway vehicle is further discussed in U.S. Pat. No. 6,367,817. ("Segway" is a trademark of its owner.)

SUMMARY OF THE INVENTION

Despite the existence of the traditional RPT and, separately, a variety of locomotive apparatuses, even ones of a typical design, there is nevertheless still a need for additional types of apparatuses, including, for example, additional types of toy apparatuses. For example, a toy that retains characteristics of a traditional RPT, and yet is mobile or has locomotive ability would provide a new form of entertaining toy.

According to an embodiment of the present invention, there is a mobile toy vehicle that includes: only a single ground-contacting roller; a weight rotatably coupled to the roller to permit rolling of the roller relative to the weight about an axis of rotation; and a member fixedly coupled to the weight during a use of the mobile toy vehicle, wherein an upper portion of the member is positioned, during the use, higher than a topmost portion of the single ground-contacting roller, and the member is counterweighted, during the use, by the weight to provide a gravity-based restoring force sufficient for preventing toppling of the member despite user-noticeable swaying of the member due to inertial forces during rolling of the roller about the axis of rotation.

According to an embodiment of the present invention, there is a mobile apparatus for providing entertaining movement. The apparatus includes: one or more ground-contacting rollers that have a common axis of rotation and that substantially bear weight of the mobile apparatus, and no other ground-contacting roller that substantially bears weight of the mobile apparatus; a weight and a motor drive, the weight movably coupled to at least one of the one or more ground-contacting rollers, and movable by the motor drive, to permit the at least one of the one or more ground-contacting rollers to make multiple revolutions about the axis of rotation without the weight making any full revolution about the axis of rotation; and a member, a portion of which is positioned, during locomotion of the mobile apparatus, higher than a topmost portion of the one or more ground-contacting rollers, the member coupled to the weight and counterweighted by the weight to prevent the member from toppling and touching ground, wherein position of the member is permitted to sway, noticeably to a casual human observer, due to inertial forces.

According to an embodiment of the present invention, there is a mobile apparatus for providing entertaining movement. The apparatus includes: an upper portion, at least a part of which is positioned higher than a locus, wherein the upper portion can sway relative to the locus; a lower portion coupled to the upper portion, wherein the lower portion includes mass positioned lower than is the locus; and a drive system for moving the mobile apparatus, the drive system coupled to the upper and lower portions and providing less stability of pitch or of roll for the upper portion when rolling across smooth level ground than would a rigid cart platform supported by four rolling rigid wheels centered at the corners of a top-view square, the wheels being at the ends of two equal parallel fixed axles spaced apart by at least half of a length of the mobile apparatus; wherein a motion that causes a swaying of the upper portion relative to the locus also causes a displacing of the lower portion, whereby the displacing of the lower portion causes a gravity-derived return force, the gravity-derived return force being in a direction that counters the swaying of the upper portion.

According to an embodiment of the present invention, there is a method for producing a mobile apparatus that is to have a roly-poly characteristic. The method comprises: providing at least one roller that is to touch ground during use of the mobile apparatus and that is to substantially support weight of the mobile apparatus during the use; movably coupling a weight to the at least one roller, to permit the at least one roller to roll without also rolling the weight in lockstep; coupling a member to the weight, wherein, during the use of the mobile apparatus, at least a portion of the member is to be positioned higher than a topmost portion of the at least one roller, and the member is to be counterweighted by the weight to prevent the member from toppling and touching ground, wherein position of the member is permitted to sway, noticeably to a casual human observer, due to inertial forces.

The above-mentioned embodiments and other embodiments of the present invention are further made apparent, in the remainder of the present document, to those of ordinary skill in the relevant art.

BRIEF DESCRIPTION OF THE DRAWINGS

In order to more fully describe some embodiments of the present invention, reference is made to the accompanying drawings. These drawings are not to be considered limitations in the scope of the invention, but are merely illustrative.

DETAILED DESCRIPTION OF SPECIFIC EMBODIMENTS

Figure 1:
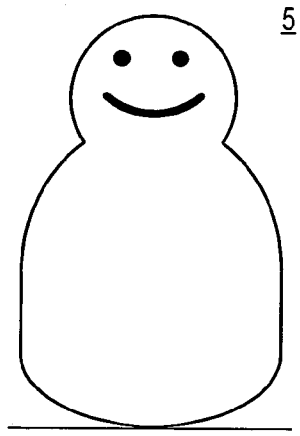
FIG. 1 (PRIOR ART)
FIG. 1 shows an example of a traditional RPT.
Figure 2A:
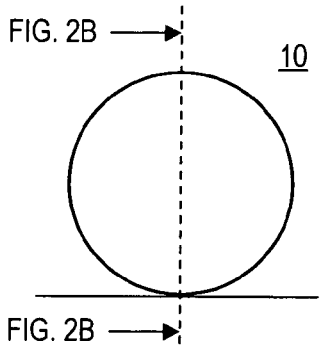
FIG. 2A (PRIOR ART)
FIGS. 2A-2B schematically show the "Sphericle", an example of a conventional single-roller toy.
Figure 2B:
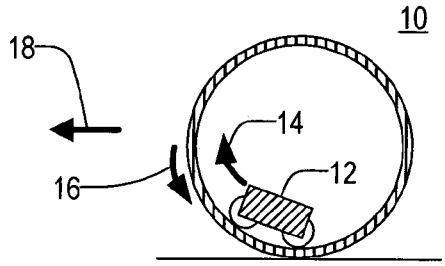
FIG. 2B (PRIOR ART)

The description above and below and the drawings of the present document refer to examples of currently preferred embodiments of the present invention and also describe some exemplary optional features and/or alternative embodiments. It will be understood that the embodiments referred to are for the purpose of illustration and are not intended to limit the invention specifically to those embodiments. For example, preferred features are, in general, not to be interpreted as necessary features. On the contrary, the invention is intended to cover without limitation alternatives, variations, modifications and equivalents and anything that is included within the spirit and scope of the invention as defined by the appended claims. To mention just one example, although preferred embodiments are detached mobile devices, other embodiments are possible, for example tethered or wire-controlled devices, or the like. The title of the present document and section titles, if any, within the present document are terse and are for convenience only.

As will be discussed in more detail below, according to some embodiments of the present invention, there is a locomotive vehicle that may be said to have roly-poly characteristics. Hereinafter, a locomotive vehicle that has roly-poly characteristics can be referred to as a "locomotive roly poly" or "LRP". For example, during locomotion (e.g., movement from place to place), an upper portion of some embodiments of an LRP teeters, preferably in a manner that is reminiscent of the teeter of a traditional (non-locomotive) RPT. For some embodiments, the LRP moves on one or more ground-contacting rollers, for example, wheels.

For some embodiments, all ground-contacting wheel(s) of one LRP have axes of rotation that are collinear, and the one LRP would be called a parallel N-cycle. (The parallel bicycle is a specific example of a parallel N-cycle, namely, a parallel N-cycle in which N equals 2.) For some embodiments, an LRP is embodied in the form of an "abreast N-cycle". An abreast N-cycle is hereby defined as a vehicle in which all ground-contacting wheels contact ground during sustained forward locomotion along a line that is closer to perpendicular than to parallel to the direction of sustained forward locomotion. For example, conventional parallel N-cycles are one particular type of abreast N-cycles. For another example, a conventional bicycle with a front wheel and a rear wheel is not an abreast bicycle. For some embodiments, even though an LRP is a parallel N-cycle or an abreast N-cycle, continual feedback-based electromechanical micro-adjustment of drive intensity (for example, of the type employed by the Segway parallel bicycle) is preferably not required to prevent the LRP from toppling during sustained locomotion. Preferably, continual feedback-based electromechanical micro-adjustment of drive intensity is not used, e.g., not used to try to maintain an upper body in a constant attitude. Preferably, continual feedback-based electromechanical micro-adjustment of drive intensity is not required to prevent the LRP from toppling even when the LRP is not engaged in locomotion. Preferably, even when the LRP is non-powered, it can remain in a non-toppled posture while all weight is supported only by ground-contacting roller(s).

FIGS. 3A-3D schematically show an LRP 20 according to some embodiments of the present invention.

Figure 3A:
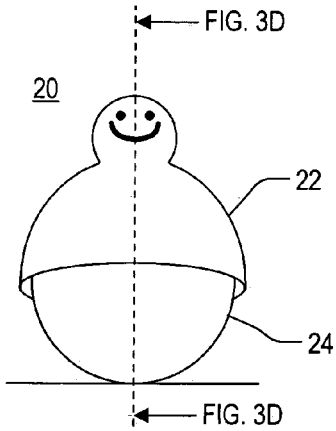
FIGS. 3A-3E schematically show embodiments of a locomotive vehicle that has roly-poly characteristics (hereinafter, "locomotive roly poly" or "LRP") and that uses a single adjustable internal weight according to an embodiment of the present invention.
Figure 3B:
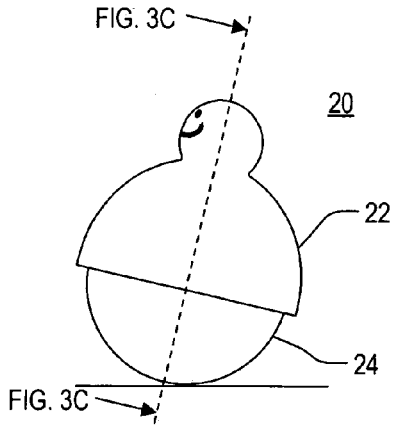

FIG. 3A is a schematic front view, and FIG. 3B is a schematic side view, of the LRP 20. A face has optionally been drawn on the LRP 20 for entertainment value of the LRP 20 and for convenience to simplify identification and distinguishing of front and side views in FIGS. 3A-3B. As seen in FIGS. 3A and 3B, the LRP 20 includes an upper body 22 and a wheel 24. Preferably, the wheel 24 is the only ground-contacting wheel of the LRP 20. Although having the LRP 20 include tails or sensors or other portions that drag or touch ground is possible, preferably, the wheel 24 is the only ground-contacting portion of the LRP 20. Preferably, the wheel 24 has a substantially spherical shape. The upper body 22 may be an uppermost member of the LRP 20. In some embodiments, the upper body 22 has a width, at a height above the wheel 24, that is greater than one quarter the diameter of the wheel 24. In some embodiments, the upper body 22 adds a height above the wheel 24 that is greater than one quarter or one third the diameter of the wheel 24. In some embodiments, the LRP 20 has a humanoid or a pear-like shape, as do some conventional roly-poly toys. As will be further discussed, when the LRP 20 undergoes locomotion, its upper body 22 rocks and swings in an entertaining manner—for example, in a roly-poly manner—due at least in part to inertial forces that arise during locomotion.

The LRP 20 may be remote-controlled by a human operator, either from a dedicated handheld controller, or the like, and/or via a communication network, for example, a local-area-network or the Internet. The LRP 20 may also, or alternatively, be navigated autonomously by a robotic controller, for example a microprocessor controller running navigation software. For example, the LRP 20 may have a user-selectable remote-controlled mode and an autonomous mode. If simplicity and low-cost are especially high-priority goals, then the remote-controlled embodiment may be preferred. The LRP 20 preferably includes a vision system (not shown), for example, a video and/or still camera that transmits its images wirelessly to one or more human operators or subscribers. The LRP 20 preferably also includes a sound input and/or output system (not shown). For example, one or more microphones and speakers that respectively transmit and receive wirelessly may be included, for example, to enable one or more human operators or subscribers of the LRP 20 to communicate vocally with entities that are in physical proximity to the LRP 20. Such optional components may be placed in any appropriate place in the upper body 22 and/or within the wheel 24.

Figure 3C:
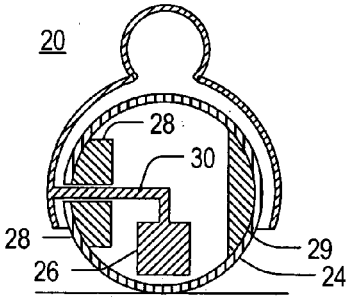
Figure 3D:
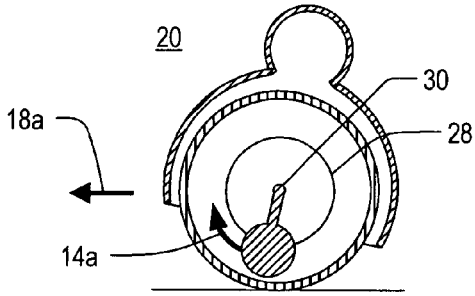

FIGS. 3C and 3D are schematic front and side section views, respectively, of the LRP 20 of FIGS. 3A and 3B. The upper body 22 is coupled to a portion 26 of the LRP 20 that has weight. The portion 26 may also be called the weight 26. The portion 26 is movably coupled to the wheel 24 such that the wheel can make even multiple revolutions relative to ground without causing the portion 26 and the upper body 22 to revolve in lockstep with the wheel 24. The coupling is via a drivetrain 28 that drives the wheel 24 relative to the portion 26, for providing locomotion. In the embodiment shown, the drivetrain 28 is connected to the wheel 24 to drive the portion 26 and the upper body 22 relative to the wheel 24. For example, the drivetrain 28 may include a motor and gearing to rotate the portion 26 and the upper body 22 together relative to the wheel 24. Motors and gearing for rotational driving is well known in the art. Alternatively to the drivetrain 28 that is shown, a drivetrain can instead be connected to, or be considered a part of, the portion 26. Either location, or a combination location, or any other location for a drivetrain is acceptable. What is preferred is that the wheel 24 and the portion 26 are driven relative to each other such that the wheel can make even multiple revolutions relative to ground without causing the portion 26 and the upper body 22 to revolve in lockstep with the wheel 24. In FIG. 3C, a block 29 is shown to schematically represent other components.

In the LRP 20, there is a shaft 30 around which the wheel 24 can revolve. Preferably, it is via the shaft 30 that the upper body 22 is coupled to the portion 26. Preferably, the drivetrain drives the wheel 24 relative to the shaft 30 such that the wheel 24 revolves around the shaft 30. Preferably, for simplicity, the shaft 30 is fixedly connected to the upper body 22. Preferably, for simplicity, the shaft 30 is fixedly connected to the weight 26. Preferably, for simplicity, the shaft 30 is fixedly connected to both the upper body 22 and to the weight 26, at least during a locomotive run of the LRP 20 in which the wheel 24 revolves relative to ground multiple times.

As is seen and discussed, the preferred shaft 30 is preferably an axle for the wheel 24. For ease of understanding, the shaft 30 has been drawn as an axle that emerges from the wheel on only one side of its axis of spin. As shown, the shaft 30 emerges from the "right-hand" side of the wheel 24, which is the left side of FIG. 3C. However, for extra strength and stability, a two-sided axle (not shown) can instead be used that emerges from both the right-hand and the left-hand side of the LRP 20 and connects to the upper body 22 at both ends of the two-sided axle. Still other configurations are possible, within the spirit and scope of embodiments of the present invention.

A roly-poly characteristic of the LRP 20 is explained with reference to FIG. 3D. Preferably, the upper body 22 and the weight 26 are configured (e.g., weight distributed), along with the rest of the LRP 20, such that equilibrium position of the upper body 22 is above the wheel 24, preferably upright. In FIG. 3D, the upper body 22 happens to be shown as being tilted back and not upright. Due to coupling between the upper body 22 and the weight 26, when the upper body 22 is tilted back as shown, the weight 26 is tilted forward as shown. If the LRP 20 is not being driven under power, then counterbalancing of the upper body 22 by the weight 26 gives a restoring force that seeks to restore the upper body 22 to its equilibrium position, in roly-poly fashion. Thus, in this embodiment, the counterbalancing is sufficient to keep the upper body 22 from toppling, and continual feedback-based electromechanical micro-adjustment of drive intensity is not used, and is not necessary, to prevent toppling of the upper body 22. The LRP 20 is allowed to tilt and wobble preferably not only in a forward/rearward direction but also sideways, too, about its single small patch of contact with the ground via its single substantially spherical wheel 24.

Forward locomotion of the LRP 20 is also explained with reference to FIG. 3D. The drivetrain 28 rotates the shaft 30 so as to move the weight 26 forward (i.e., clockwise in FIG. 3D according to an arrow 14*a*). The upper body 22 tilts backward (i.e., counterclockwise in FIG. 3D) due to coupling between the upper body 22 and the weight 26. Because the forward-rearward center of mass of the LRP 20 has become forward of the contact point between the wheel 24 and ground, gravity causes the LRP 20 to roll forward. Because the drivetrain 28 continues to power the weight 26 to a position that is forward of the contact point between the wheel 24 and ground, the LRP 20 continues to roll forward, in the direction of an arrow 18*a* in FIG. 3D, to thereby obtain sustained locomotion. Stopping of forward locomotion may be accomplished by stopping power to the drivetrain 28, after which the weight 26 would hang downward in its equilibrium position. Then, at least friction will stop rotation of the wheel 24 relative to ground and relative to the shaft 30. For quicker stopping of forward locomotion, and for reverse locomotion, the drivetrain 28 may simply be driven in reverse, such that the weight 26 swings rearward (i.e., counterclockwise in FIG. 3D).

Preferably, the drivetrain 28 never lifts the weight 26 with sufficient, and sufficiently sustained, torque to cause the weight 26 to make a full revolution around the rolling axis of the shaft 30. Preferably, the drivetrain 28 does move the weight 26, at least occasionally during locomotion, at least 5 degrees, or at least 10 degrees, from a vertical hang. For example, the forward-rearward center of mass of the weight 26 is displaced forward from the rolling axis of the wheel 24 by an angle that is at least 5 degrees, or at least 10 degrees. Preferably, the drivetrain 28 is configured such that the motor, given its gearing, and given the level of power selected by the human or autonomous controller, is not powerful enough to raise the weight 26 more than a maximum amount from its equilibrium position, e.g., from a vertical hang. In this preferred embodiment, the drivetrain 28 lifts the weight until the weight will go no higher. For example, for a given amount of power permitted by the human or autonomous controller, the maximum degree may be no more than 15 degrees, or no more than 45 degrees, or no more than some other maximum that is less than 90 degrees. For simplicity, it is preferred that the intentional weakness of the drivetrain 28 is the only automatic stabilizing force on the position of the weight 26 and on the motion of the upper body 22 relative to vertical, and that continual feedback-based electromechanical micro-adjustment of drive intensity is not used, and is not necessary, to prevent toppling of the upper body 22.

Figure 3E:
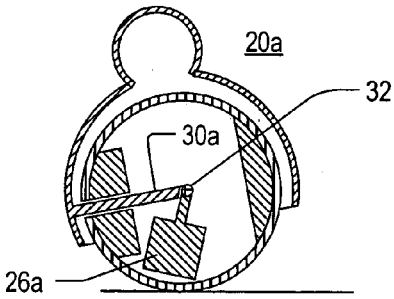

FIG. 3E is a schematic front section view of an embodiment, LRP 20*a*, of the LRP 20 of FIGS. 3A-3D. The LRP 20*a* includes components analogous to components of the LRP 20 of FIGS. 3A-3D. For example, the LRP 20*a* includes a weight 26*a* that is analogous to the weight 26 of the LRP 20. The LRP 20*a* includes a mechanism that shifts the left-right center of mass of the LRP 20*a*, either leftward or rightward, as considered from the point of view of an upright LRP 20*a*. For example, as shown in FIG. 3E, the weight 26*a* has been shifted rightward, from the LRP 20's point of view (i.e., leftward in FIG. 3E). Then, during forward locomotion as discussed above, the LRP 20 would tend to roll forward and also rightward from its point of view (i.e., also leftward in FIG. 3C), and the LRP 20*a* would make a circular path.

For example, the mechanism may be a stepper motor (not shown) that swings the weight 26*a* in a left-right direction about a hinge 32. Any other weight-shifting mechanism may also be used. For example, a motorized sliding mechanism may instead be used that moves the weight 26*a* linearly horizontally (not shown in FIG. 3E), instead of (as shown in FIG. 3E) along a swing arc.

FIGS. 4A-4E schematically show an embodiment, LRP 20*b*, that uses dual adjustable internal weights according to an embodiment of the present invention. In general, description above in connection with the LRP 20 of FIGS. 3A-3D preferably applies to the LRP 20*b* of FIGS. 4A-4E as well, unless context or meaning demands otherwise.

Figure 4A:
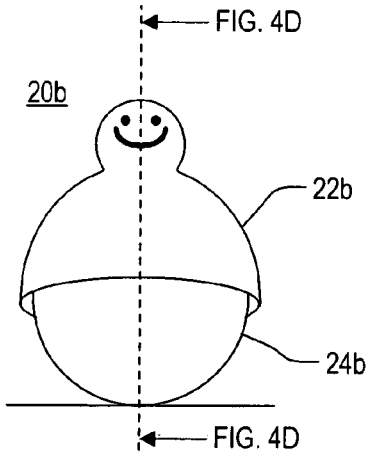
FIGS. 4A-4E schematically show an embodiment of an LRP that uses dual adjustable internal weights according to an embodiment of the present invention.
Figure 4B:
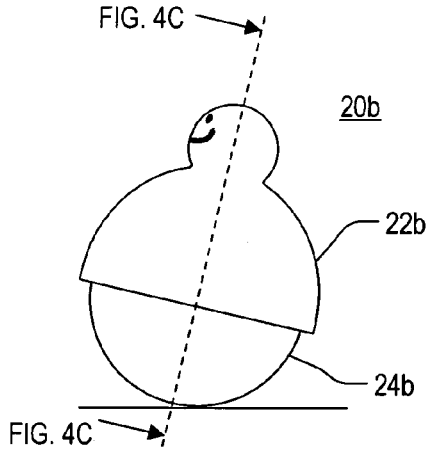

FIG. 4A is a schematic front view, and FIG. 4B is a schematic side view, of the LRP 20*b*. An optional face has been drawn on the LRP 20*b* for entertainment value and for convenience to simplify identification and distinguishing of front and side views in FIGS. 4A-4B. As seen in FIGS. 4A and 4B, the LRP 20*b* includes an upper body 22*b* and a wheel 24*b*.

Figure 4C:
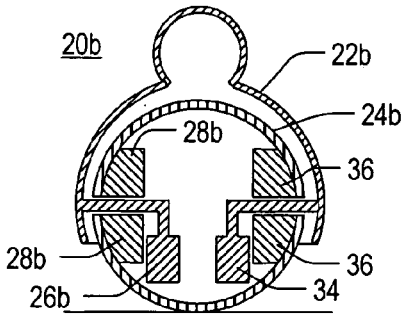
Figure 4D:
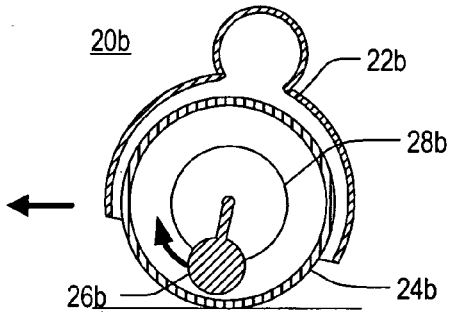

FIGS. 4C and 4D are schematic front and side section views, respectively, of the LRP 20*b* of FIGS. 4A and 4B. The upper body 22*b* is coupled to a portion 26*b* of the LRP 20*b* that has weight. The portion 26*b* may also be called the weight 26*b*. The portion 26*b* is movably coupled to the wheel 24*b* such that the wheel can make even multiple revolutions relative to ground without causing the portion 26*b* and the upper body 22*b* to revolve in lockstep with the wheel 24*b*. The coupling is via a drivetrain 28*b* that drives the wheel 24*b* relative to the portion 26*b*. For example, the drivetrain 28*b* may drive a shaft 30*b* that is (e.g., fixedly) coupled to the upper body 22*b* and the weight 26*b*. In the LRP 20*b*, there is a portion 34 that has weight. The portion 34 may also be called the weight 34. The weight 34 is movably coupled to the wheel 24*b* such that the wheel can make even multiple revolutions relative to ground without causing the weight 34 to revolve in lockstep with the wheel 24*b*. The coupling is via a drivetrain 36 that drives the wheel 24*b* relative to the weight 34. For example, the drivetrain 36 may drive a shaft 38 that is (e.g., fixedly) coupled to the weight 34. Similarly to prior discussion, any placement of the drivetrains 28*b* and 36 would be acceptable. What is preferred is that the drivetrains 28*b* and 36 can correctly position the weights 26*b* and 34 for locomotion and navigation, as is discussed further below.

The weights 26*b* and 34 can be operated in lockstep, for forward or rearward linear locomotion. When the weights 26*b* and 34 are operated in lockstep, forward and rearward locomotion of the LRP 20*b* is conceptually the same as forward and rearward locomotion of the LRP 20 of FIGS. 3A-3D, and is therefore already discussed above.

The weights 26*b* and 34 can be driven not in lockstep. When the weights 26*b* and 34 are driven not in lockstep, as described below, they can be driven to cause turning and change of locomotive direction. For example, when one weight is being accelerated in a forward direction, and the other weight is also being driven in a forward direction, but with a smaller acceleration (e.g., at a constant velocity), then the robot will turn in the direction of the lower-speed rotating side. For another example, when one weight is held in a forward direction, for example, with its center-of-mass moved about 10 degrees rearward of a vertical hang, and the other weight is being held in a rearward direction, for example, with its center-of-mass moved about 10 degrees rearward of a vertical hang, then the robot will become stalled in an upright position.

Figure 4E:
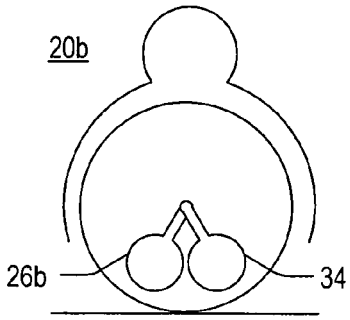

FIG. 4E is a schematic diagram of the LRP 20*b* that shows relative positions of the weights 26*b* and 34, as seen from the left side of the LRP 20*b*. In FIG. 4E, as in FIGS. 4B and 4D, the leftward direction of the drawing is the forward direction of the LRP 20*b*. In FIG. 4E, the weights 26*b* and 34 are held in opposite directions relative to the wheel's axis of rolling, and the robot is stalled in an upright position.

For ease of understanding, the shaft 30*b* has been drawn in FIG. 4C as an axle that emerges from the wheel on only one side of its axis of spin. As shown, the shaft 30*b* emerges from the "right-hand" side of the wheel 24*b*, which is the left side of FIG. 4C, to couple to the upper body 22*b*. However, for extra strength and stability, the upper body 22*b* may be supported by the wheel at both sides of the wheel's rolling axis. For example, as has been discussed in connection with FIG. 3C, a two-sided axle (not shown) can be used, instead of the one-sided axle 30*b*. For example, the two-sided axle can emerge from both the right-hand and the left-hand side of the LRP 20*b* and connect to the upper body 22*b* at both ends of the two-sided axle. For example, the shaft 38 can be made to have larger outside diameter than the shaft 30*b*, and to have an internal bore, with roller bearings, through which the shaft 30*b* rotates independently of the shaft 38, in a co-axial fashion. Still other configurations are possible, within the spirit and scope of embodiments of the present invention.

Figure 5A:
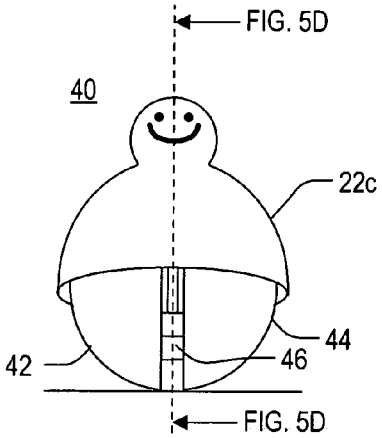
FIGS. 5A-5E schematically show embodiments of a LRP that uses dual wheels in a parallel-bicycle configuration, according to an embodiment of the present invention.
Figure 5B:
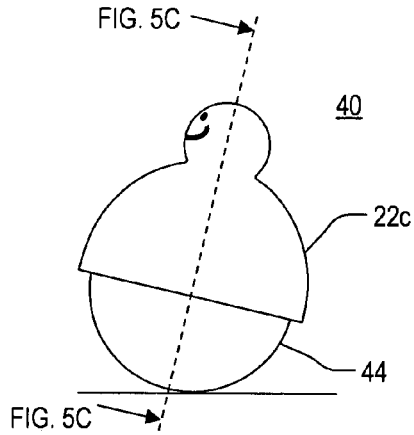

FIGS. 5A-5B schematically show an LRP 40 that uses dual wheels in a parallel-bicycle configuration, according to some embodiments of the present invention. As can be seen, the LRP 40 includes an upper body 22*c* and a right-side wheel 42 and a left wheel 44. There is an internal portion 46 that has weight that counterbalances the body 22*c* to keep the body 22*c* relatively upright. The internal portion 46 may also be referred to as the weight 46. The internal portion 46 and the upper body 22*c* move about during locomotion due at least in part to inertial forces, at least in the forward/rearward direction. If the two wheels 42 and 44 are capable of being rotated independently, then the LRP 40 can turn leftward or rightward by the same method as tractors or military tanks-namely, by turning one wheel forward faster than the other, or even by turning one wheel forward while turning the other one rearward.

If the gap between the two wheels 42 and 44 is very narrow, and the two wheels 42 and 44 are joined to move in lockstep, then the two wheels can still behave similarly to, though perhaps not as totteringly side to side as, a single spherical wheel. If the gap is very narrow, the LRP 40 can be internally like the LRPs 20, 20*a*, or 20*b* discussed above in connection with FIGS. 3A-3E and 4A-4E. For example, if the LRP 40's wheels 42 and 44 act as the single wheel of the LRPs 20, 20*a*, or 20*b*, then the gap between the two wheels 42 and 44 will permit another location, other than the axles 30, 30*a*, or 30*b*, by which the weights 26, 26*a*, or 26*b* may be coupled to the upper bodies 22 or 22*b* in the LRPs 20, 20*a*, or 20*b*.

Figure 5C:
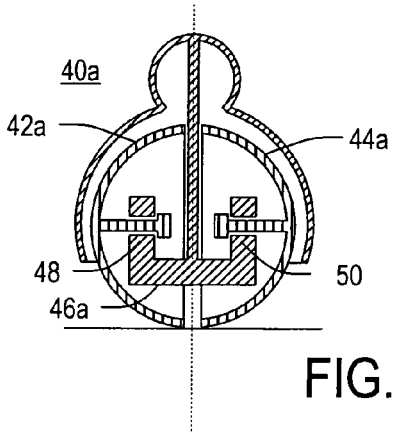
Figure 5D:
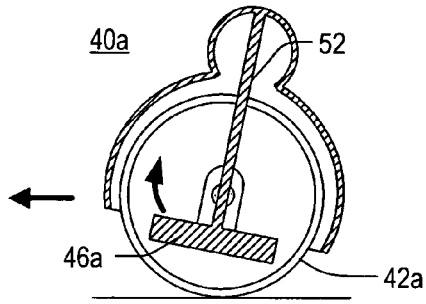

FIGS. 5C-5D are schematic front and side section views that schematically show one embodiment, LRP 40*a*, of the LRP 40 of FIGS. 5A-5B. As is seen, the LRP 40*a* includes a weight 46*a* that includes two drivetrains 48 and 50 that respectively and independently drive wheels 42*a* and 44*a*. A support member 52 supports an upper body 22*d*.

Figure 5E:
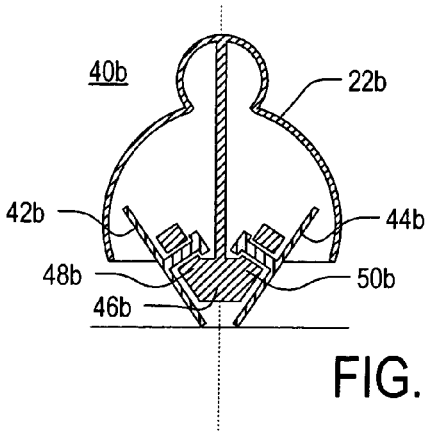

FIG. 5E is a schematic front section view that schematically shows an LRP 40*b* that is a variant of the LRP 40*a* of FIGS. 5C-5D. The difference is that the axles of the two wheels 42*b* and 44*b* of the LRP 40*b* are not collinear, but instead each angle downward. Thus, the LRP 40*b* is not, formally, a parallel-bicycle. Instead, the LRP 40*b* is an abreast bicycle, which is an abreast N-cycle in which N equals two. The two wheels 42*b* and 44*b* of the LRP 40*b* are independently driven by drivetrains 48*b* and 50*c*.

Figure 6:
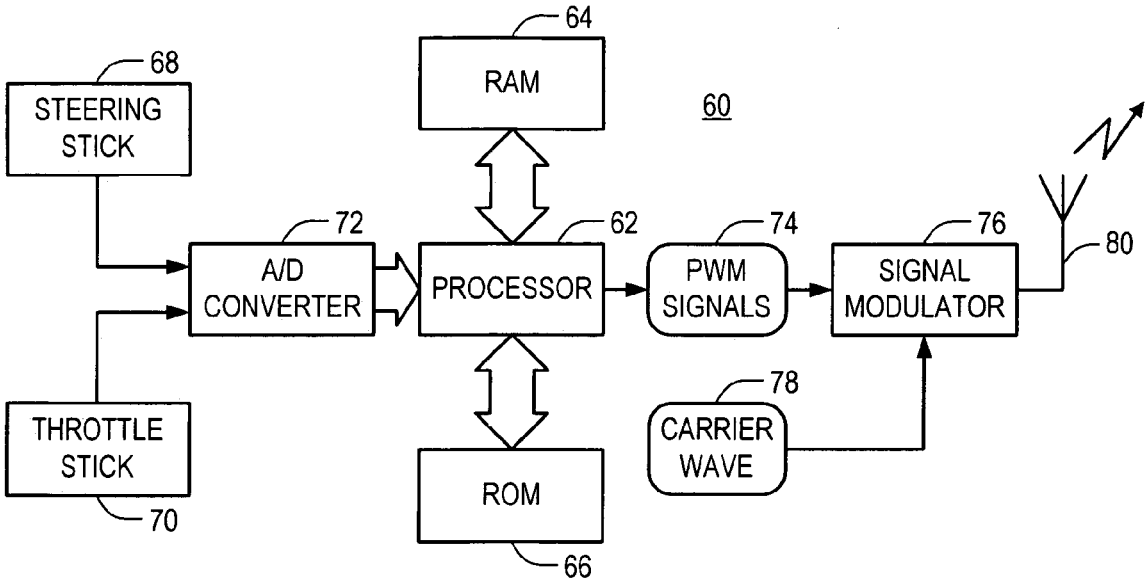
FIG. 6 schematically shows a remote control suitable for controlling a LRP.

FIG. 6 schematically shows an example of a wireless remote controller 60 suitable for controlling an LRP. The remote controller 60 includes a processor 62 (e.g., a microprocessor) and its memory, including, e.g., data memory 64 (for example, random-access memory (RAM)), and program memory 66 (for example, read-only memory (ROM)). A steering stick 68 and a throttle stick 70, or any other conventional input device, for example a voice-recognition system that recognizes voice commands (e.g., "left", "right", "forward", "stop", and the like), permits a human operator to input left-right or forward-rearward signals. An analog-to-digital converter 72 converts the signals into digital format for use by the microprocessor 62. The microprocessor would than convert the two signals into a signal according to any suitable control code that the LRP is programmed to understand. For example, the two signals can be converted into pulse-width-modulation (PWM) signals that are in relation and in proportion to the position of the steering stick and the throttle stick, for example, with duty cycle from 1%-100%. The PWM signal would than be combined by a signal modulator 76 with a carrier wave 78 to create a modulating wave that is transmitted to the LRP through an antenna 80. Any other remote-controller, for example, any conventional remote controller may also be configured for use to control an LRP.

Figure 7:
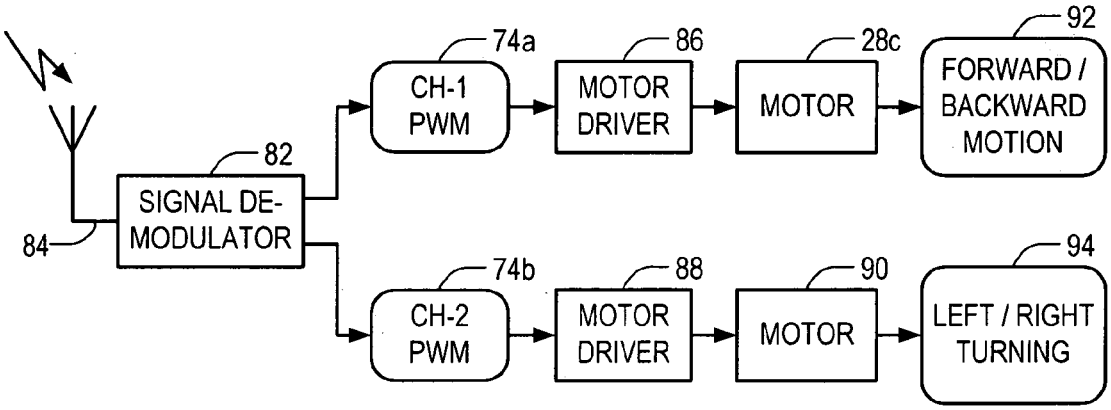
FIG. 7 schematically shows an on-board receiver, controller, and drivetrain that are suitable for controlling and driving an LRP.

FIG. 7 schematically shows an example of an on-board receiver, controller, and drivetrain that are suitable for controlling and driving an LRP in remote-control mode. A microcontroller and receiver are mounted in the LRP. The receiver will receive signals from the wireless remote controller 60, in remote-control mode (as opposed to autonomous). A signal demodulator 82 receives an incoming signal from an antenna 84 and decodes the incoming signal to obtain the original PWM signals, including, for example, a channel-1 PWM signal 74*a* and a channel-2 PWM signal 74*b* that respectively control forward-rearward motion and leftward-rightward turning. Then, the control circuitry on the particular LRP controls the drivetrain of the LRP appropriately in response to the PWM signals 74*a* and 74*b*. For example, for an LRP that is as discussed in connection with FIG. 3E—i.e., that has a single weight that can be shifted forward-rearward by one motor and sideways by another motor—, the processing is as indicated in FIG. 7.

In FIG. 7, the PWM signals 74*a* and 74*b* are respectively converted by motor drivers 86 and 88 (e.g., H-bridge drivers) into corresponding driver voltages for two respective motors, motor 28*c* and motor 90 (for example, direct current (DC) motors). Motor 28*c* moves a weight (not shown in FIG. 7) forward or rearward, and the motor 28*c* moves a weight sideways, respectively to obtain forward/backward motion 92 and left/right turning 94.

FIGS. 8A-8F schematically show an embodiment of an LRP that uses a internal weight that is adjustable sidewise according to an embodiment of the present invention. The embodiment shown is a detailed implementation of the embodiment, discussed above in connection with FIG. 3E.

Figure 8D:
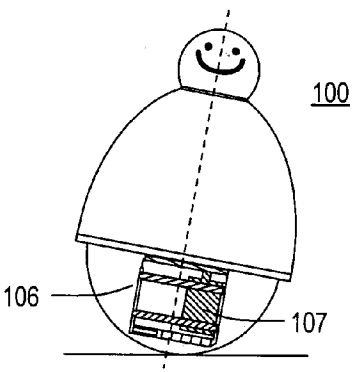
FIGS. 8A-8F schematically show an embodiment of an LRP according to an embodiment of the present invention.
Figure 8F:
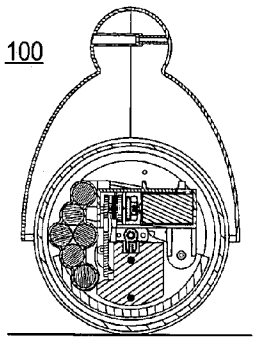
Figure 8B:
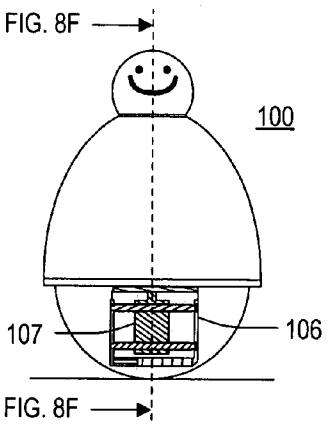
Figure 8A:
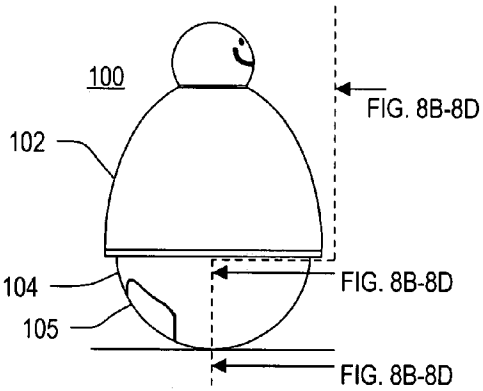

FIG. 8A is a schematic side view of an LRP 100 that has an upper body 102 and a wheel 104. The wheel 104 has a cover 105 that permits access for an internal battery compartment. An optional face has been drawn on the upper body 102 for entertainment and to help communicate directional orientation of the LRP 100 in the drawings.

Figure 8C:
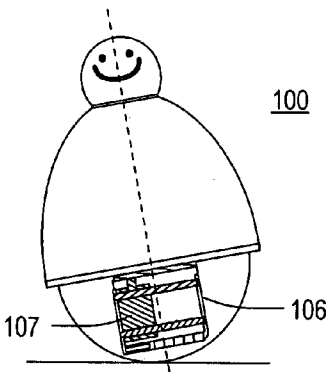

FIGS. 8B-8D are schematic front views of the LRP 100. In FIGS. 8B-8D, the wheel 104 is drawn in section view, but for clarity only selected components are shown within the wheel 104. In particular, there is a weight that includes a main weight body 106 and a sidewise adjustable weight 107. The sidewise adjustable weight 107 is configured to be movable from side to side, to effect turning of the LRP 100, in a manner as has been discussed in connection with FIG. 3E. FIG. 8B shows the sidewise adjustable weight 107 positioned in the middle, for forward/rearward motion. FIGS. 8C and 8D show the weight positioned rightward or leftward, from the LRP 100's point of view, for rightward or leftward turning, respectively.

Figure 8E:
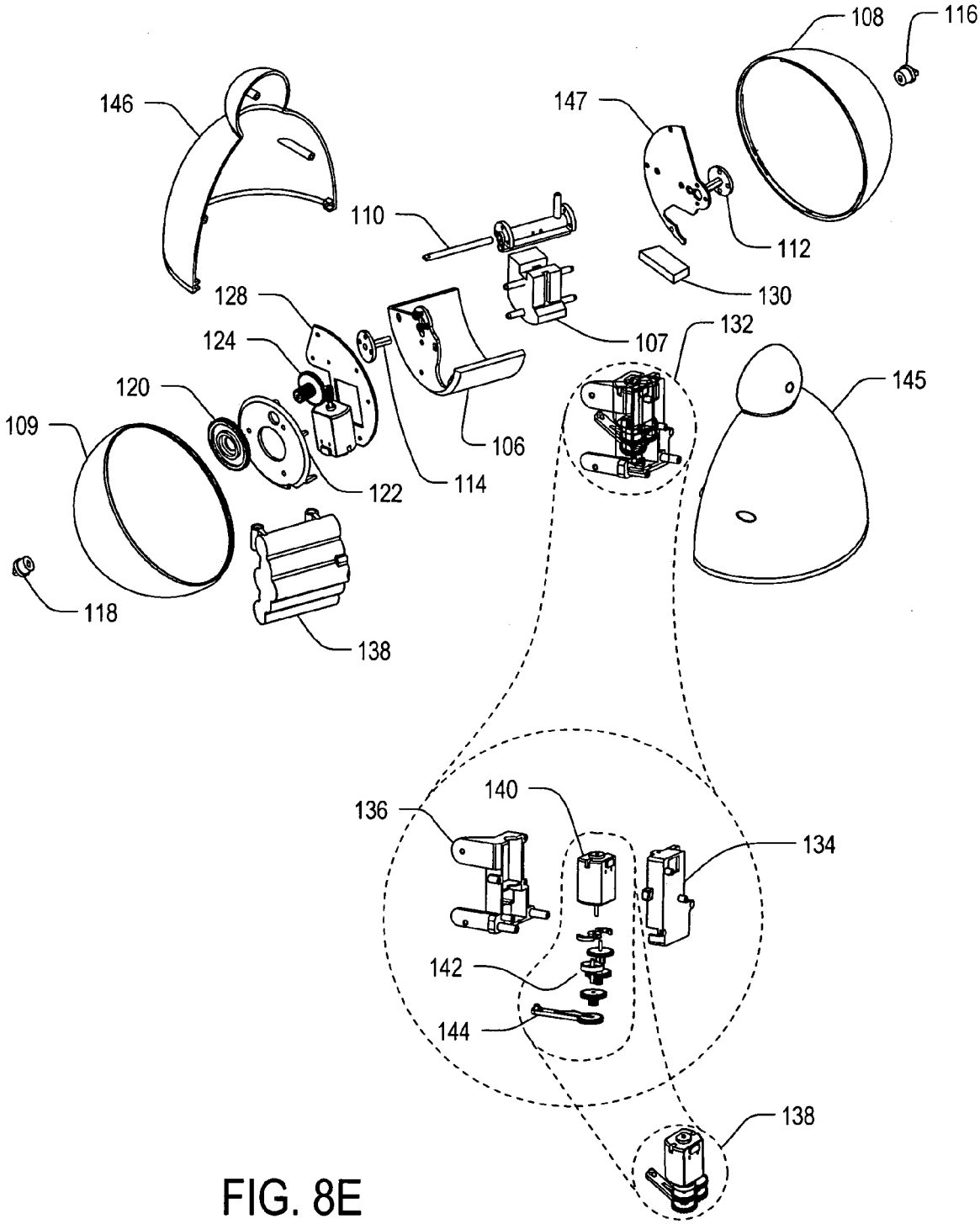

FIG. 8E is a schematic exploded view of the LRP 100. Two wheel halves 108 and 109 make up the wheel 104 (from FIGS. 8A-8D) of the LRP 100. The main weight body weight 106 is attached to a shaft 110 via shaft holders 112 and 114. The shaft 110 is connected at its two ends to bearing assemblies 116 and 118, respectively. The bearing assemblies 116 and 118 permit the shaft to rotate relative to the spherical wheel 104. The bearing assemblies 116 and 118 may be ball or roller bearing assemblies. The main weight body 106 is fixed to the shaft 110. The sidewise adjustable weight 107 is coupled to the fixed weight 106 and is movable sidewise relative to the fixed weight 106.

A gear set includes gears 120, 122 and 124. This gear set couples a first D.C. motor 126 to drive the shaft 110 relative to the spherical wheel 104, to generate forward/backward swing of the weights 106 and 107 and thereby cause locomotion for LRP 100. The ratio obtained by the gear set, in a particular embodiment, is 1:150. A cover 128 is fixed to an interior wall of the spherical wheel 104 and to the motor 126. A controller 130 includes control elements.

A side-drive assembly 132 is configured to move the sidewise adjustable weight 107 from side to side within a cavity formed by the main weight body 106. The side-drive assembly 132 includes housing portions 134 and 136 that house a motor set 138. The motor set 138 includes a second D.C. motor 140, a gear set 142, and a swing arm 144. The swing arm 144 is inserted in a vertical slot of the sidewise adjustable weight 107. Two pins are fixed in the main weight body 106 and slideably through bores in the sidewise adjustable weight 107. The sidewise adjustable weight 107 can slide side-to-side on the two pins. The sidewise adjustable weight 107 is positioned within a cavity defined by the main weight body 106. Normally, the sidewise adjustable weight 107 will be controlled to be at the sidewise center of the main weight body 106. If a human player (or an onboard robotic controller) asks the LRP 100 to move in a leftward (or rightward) direction, the controller 130 will control the second motor set 138 to have the swing arm 144 move the sidewise adjustable weight 107 leftward (or rightward).

The upper body 102 (of FIGS. 8A-8D) includes halves 145 and 146. The upper body 102 is fixed to the shaft 110 and thereby to the weights 106 and 107. Accordingly, the assembly that includes the upper body 102 and the weights 106 and 107 is rotatably suspended from the wheel 104 at bearing assemblies 116 and 118 so that the upper body 102 swings freely under the influence of the weight distribution and momentum of the assembly. The shaft 110 is located through the central axis of the sphere horizontally. Commonly, the main weight body 106 and/or the sidewise adjustable weight 107 are made of a higher density material (e.g., cast iron, lead alloy, or the like). However, the weight used for locomotion and turning need not be inert. For example, functional components such as batteries or any other components can also be used as part of the weight. The weight is most efficient if it is extended as near to the inner surface of the spherical wheel 104 as possible. A cover 147 is a sidewall of the main weight body 106, and a battery compartment 148 holds batteries that power the motors.

FIG. 8F is a side section view of the LRP 100. This views is self explanatory, in view of above discussion in connection with FIGS. 8A-8E.

Figure 9A:
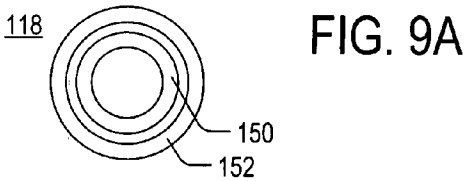
FIGS. 9A-9B schematically show a bearing assembly in close up.
Figure 9B:
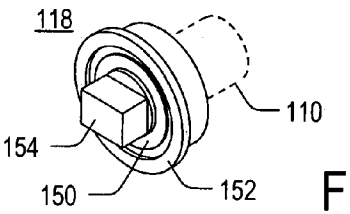

FIGS. 9A-9B schematically show the bearing assembly 118 (or 116) in greater detail. As is seen, the bearing assembly 118 includes an inner layer 150 and an outer layer 152 that can rotate relative to each other on ball bearings. The inner layer 150 is fixed to the shaft 110. An end cap 154 is fixed to the shaft 110 to provide greater size for a more secure fixed connection with the wheel 104.

Throughout the description and drawings, example embodiments are given with reference to specific configurations. It will be appreciated by those of ordinary skill in the art that the present invention can be embodied in other specific forms. The scope of the present invention, for the purpose of the present patent document, is not limited merely to the specific example embodiments of the foregoing description, but rather is indicated by the appended claims. All changes that come within the meaning and range of equivalents within the claims are to be considered as being embraced within the spirit and scope of the claims.

What is claimed is:

1. A mobile toy vehicle, comprising:

a wheel;

a weight coupled to the wheel via a shaft, including a main weight and a sidewise adjustable weight, wherein the main weight is fixed to the shaft, and the sidewise adjustable weight is coupled to the main weight and is movable sidewise relative to the main weight;

an outer body member fixedly coupled to the main weight and the sidewise adjustable weight, wherein the outer body member and the main weight are rotatable relative to the wheel so that the outer body member can swing relative to the wheel;

a first motor to drive the shaft relative to the wheel so as to generate forward/backward swing of the main weight and the sidewise adjustable weight to thereby cause locomotion the vehicle; and a side-drive assembly configured to move the sidewise adjustable weight from side to side within a cavity formed by the main weight body.

2. The mobile toy vehicle as described in claim 1, wherein the sidewise adjustable weight is disposed within a cavity formed by the main weight.

3. The mobile toy vehicle as described in claim 2, wherein the side-drive assembly includes a swing arm configured to move the sidewise adjustable weight leftward or rightward.

4. The mobile toy vehicle as described in claim 3, wherein the swing arm is inserted in a vertical slot of the sidewise adjustable weight.

5. The mobile toy vehicle as described in claim 2, wherein the shaft is connected at its two ends to the wheel by a bearing, the bearing permitting the shaft to rotate relative to the wheel.

6. The mobile toy vehicle as described in claim 5, wherein the bearing includes an inner layer and an outer layer that can rotate relative to each other on ball bearings, wherein the inner layer is fixed to the shaft.

* * * * *